US006147932A

United States Patent [19]

Drumheller

[11] Patent Number: 6,147,932

[45] Date of Patent: Nov. 14, 2000

[54] ACOUSTIC TRANSDUCER

[75] Inventor: Douglas S. Drumheller, Cedar Crest, N. Mex.

[73] Assignee: Sandia Corporation, Albuquerque, N. Mex.

[21] Appl. No.: 09/307,266

[22] Filed: May 6, 1999

[51] Int. Cl.[7] ..... H04R 17/00

[52] U.S. Cl. ..... 367/165; 367/82; 367/157

[58] Field of Search ..... 367/82, 157, 159, 367/165, 166

[56] References Cited

U.S. PATENT DOCUMENTS 5,357,486 10/1994 Pearce ..... 367/159

5,703,836 12/1997 Drumheller ..... 367/165

*Primary Examiner*—Ian J. Lobo

*Attorney, Agent, or Firm*—Russell D. Elliot

[57] ABSTRACT

An active acoustic transducer tool for use down-hole applications. The tool includes a single cylindrical mandrel including a shoulder defining the boundary of a narrowed portion over which is placed a sandwich-style piezoelectric tranducer assembly. The piezoelectric transducer assembly is prestressed by being placed in a thermal interference fit between the shoulder of the mandrel and the base of an anvil which is likewise positioned over the narrower portion of the mandrel. In the preferred embodiment, assembly of the tool is accomplished using a hydraulic jack to stretch the mandrel prior to emplacement of the cylindrical sandwich-style piezoelectric transducer assembly and anvil. After those elements are positioned and secured, the stretched mandrel is allowed to return substantially to its original (pre-stretch) dimensions with the result that the piezoelectric transducer elements are compressed between the anvil and the shoulder of the mandrel.

17 Claims, 3 Drawing Sheets

ACOUSTIC TRANSDUCER

This invention was made with Government support under Contract DE-AC04-94AL85000 awarded by the U.S. Department of Energy. The Government has certain rights in the invention.

BACKGROUND OF THE INVENTION

This invention relates to the field of acoustic transducers that use piezoelectric elements installed on a mandrel as acoustic signal generators for use in downhole telemetry applications. More particularly, the invention relates to an improved transducer apparatus configuration and method of assembly allowing wider machining tolerances and easier assembly than an earlier version of acoustic transducer patented by the applicant herein.

Background technology underlying recent developments in acoustic telemetry is described in detail in U.S. Pat. No. 5,703,836, which is incorporated herein in its entirety. Also incorporated by reference in its entirety is the patent application Ser. No. 09/306,672 filed in the United States Patent and Trademark Office on the same day as the instant application. Briefly, however, real time or near-real time data acquisition is advantageous in assessing and optimizing performance of subterranean equipment, such as is used in gas and oil wells. Often, in situ use of commonly employed data acquisition instruments is impossible or impractical due to harsh conditions that exist downhole. Communications can be established by way of hardwire connections between downhole and surface elements, however, such connections have proven to be expensive and unreliable under certain conditions. Likewise, attempts to employ traditional radio communications have been largely unsuccessful due to large electromagnetic attenuation.

For these reasons and others, communications systems have been developed that use the drill string elements, themselves, as a wave guide for communications signals. An example of this is the acoustic transducer described in the '836 patent mentioned above. The transducer in that patent comprises a hollow unitary mandrel having a cylindrical recess formed in the outer wall of the mandrel within which recess is captured a stack of piezoelectric elements in a temperature compensated interference fit. The transducer assembly also includes a power source and a protective shell that covers the region of the mandrel and captures the piezoelectric elements. The mandrel can be adapted to connect to production tubing that serves as the waveguide between the transducer downhole and the surface. The transducer is further adapted to receive information from a downhole measurement device such as a pressure/temperature gage.

Acoustic transducers tools, such as the one disclosed in the '836 patent, employ stressed piezoelectric elements. Compression of the piezoelectric elements is desirable to protect the ceramics from tensile failure. In the '836 patent a stack of washer-shaped piezoelectric discs is positioned about a cylindrical recess formed in a hollow mandrel. The discs are securely retained by thermal-expansion compensating rings which are, in turn, secured by the edge of the recess into which the discs and compensating rings are positioned. In the version of the apparatus disclosed in the '836 patent, the necessary compressive stress is obtained as a consequence of the method of assembly described there. Specifically, according to that method, the piezoelectric discs and thermal-expansion compensating rings are provided as pairs of half-cylinders that are emplaced in the cylindrical recess of the mandrel. The positioning of the half-cylinders takes place after the mandrel has been heated to sufficient temperature so as to cause the mandrel (and consequently the cylindrical recess cut into the mandrel) to expand slightly. At that point, the halves of the transducer elements and temperature compensating rings are positioned in the expanded recess, and the mandrel is allowed to cool. As the cooling takes place the mandrel contracts and the piezoelectric elements are captured securely in an interference fit in the mandrel recess.

While it is useful in many instances, the method of assembly just described can, however, prove cumbersome and difficult under certain conditions. Therefore, an unmet need exists for a simplified transducer apparatus and a simpler assembly method.

SUMMARY OF THE INVENTION

The present invention provides a simplified acoustic transducer characterized by a one-piece mandrel in the form of a modified cylinder symmetric about a central axis. The mandrel has a first mandrel region including an outer surface substantially parallel to the central axis and at a first substantially constant radial distance from the central axis. The mandrel also has a second mandrel region including an outer surface substantially parallel to the central axis and at a second substantially constant radial distance from the central axis, the second substantially constant radial distance being less than the first substantially constant radial distance. The first region includes a shoulder member extending from the outer surface of the first region to the outer surface of the second region. The transducer apparatus further includes an anvil in the form of a cylinder symmetric about the central axis and having first and second ends, an outer anvil surface substantially parallel to the central axis and at a third substantially constant radial distance from the central axis, and a central aperture bound by an inner anvil surface that is substantially parallel to the central axis. The inner anvil surface is at a fourth substantially constant radial distance from the central axis, the fourth substantially constant radial distance being less than the third substantially constant radial distance but, in the assembled condition, only slightly greater than the second substantially constant radial distance, resulting in an interference fit between the inner anvil surface and the outer surface of the second mandrel region. The anvil also includes a base member in the region of the first end extending from the outer anvil surface to the inner anvil surface. The anvil is positioned so that part of the second region of the mandrel passes through the central aperture bound by the inner surface of the anvil. The acoustic transducer apparatus also includes a plurality of washer-shaped discs having an outer radius and an inner radius, the inner radius being slightly larger than the substantially constant radial distance associated with the outer surface of the second region of the mandrel, and the outer radius being larger than the inner radius. The plurality of discs are captured between the shoulder member of the first region of the mandrel and the base of the anvil in a pre-stressed interference fit.

Advantages and novel features will become apparent to those skilled in the art upon examination of the following description or may be learned by practice of the invention. The objects and advantages of the invention may be realized and attained by means of the instrumentalities and combinations particularly pointed out in the appended claims.

DESCRIPTION OF THE FIGURES

The accompanying drawings, which are incorporated into and form part of the specification, illustrate embodiments of the invention and, together with the description, serve to explain the principles of the invention.

DETAILED DESCRIPTION OF THE INVENTION

This disclosure pertains to improvements to the acoustic transducer described in U.S. Pat. No. 5,703,836. In that earlier disclosure, the transducer elements are emplaced into a slot in the mandrel as two half cylinders. The half cylinders each comprise two portions, which are present for compensation of thermal expansion, and one sandwich-style PZT ceramic assembly (also provided in two portions). This PZT ceramic assembly serves as the active transducer element. An axial interference fit exists between the half cylinders and the mandrel. This places the mandrel in axial tension while the half cylinders are in axial compression. This pre-stress is critical to the proper operation of the tool. The ceramics must not be put into tension because the PZT is weak in tension.

Figure 1:
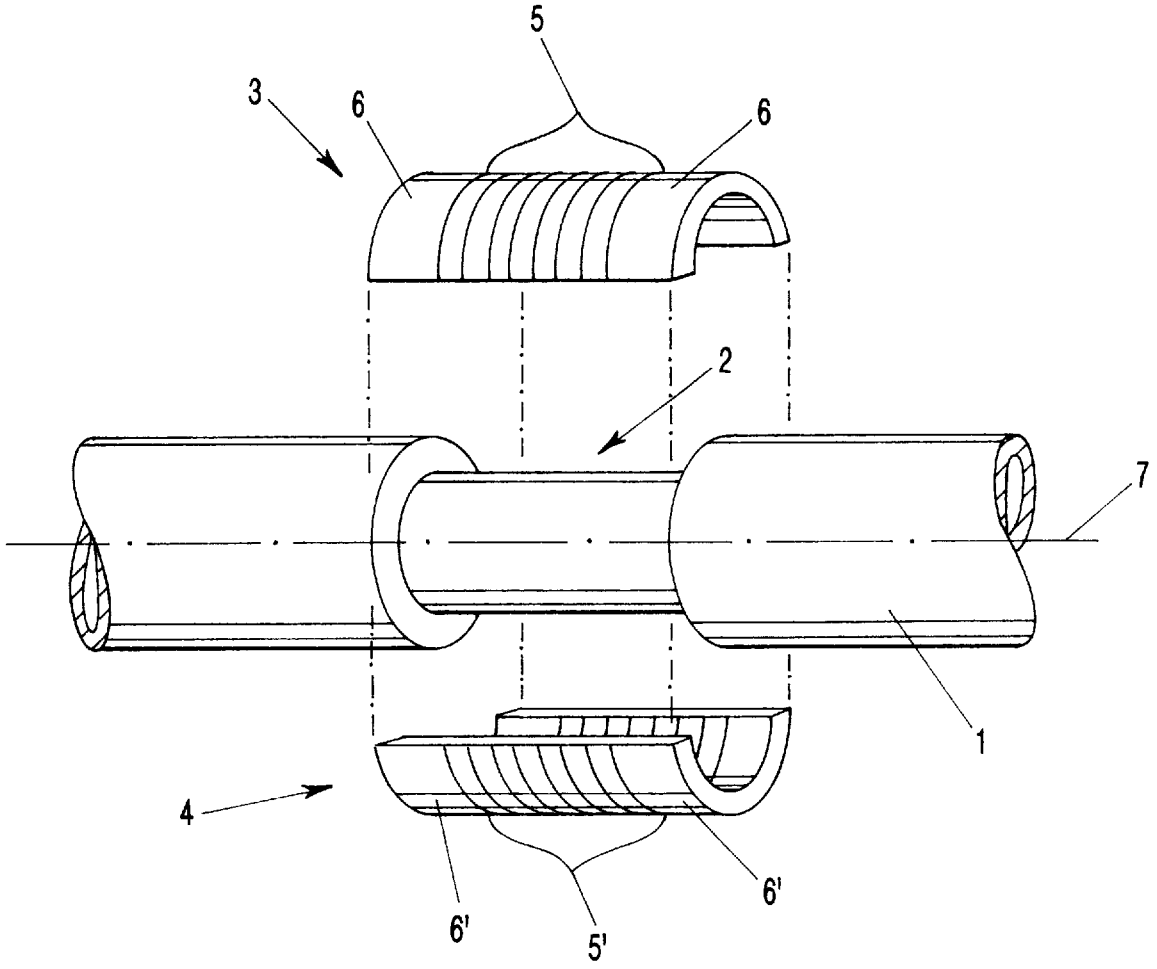
FIG. 1 is a partially-exploded side view of a the portion of an acoustic transducer mandrel with transducer elements positioned as described in the '836 patent.

FIG. 1 illustrates an example of the type of assembly just described. A mandrel 1 is provided which includes a cylindrical recess 2. A cylindrical sandwich-style transducer is provided which, when the transducer and the mandrel are at or close to the same temperature, has a length slightly longer than the length of the recess 2. The cylindrical sandwich-style transducer comprises two portions, 3 and 4, each of which forms substantially half of the overall transducer unit. Each half includes stacked piezoelectric elements 5 and 5' which, when assembled, surround the mandrel 1 in the region of the cylindrical recess 2. Each half portion of the sandwich-style transducer likewise includes two thermal expansion rings (expansion compensators) 6 and 6' located on either end of the stack of piezoelectric elements, 5 and 5', respectively. In this embodiment described in the '836 patent, the mandrel 1 is heated so that it expands along its axial dimension 7. As the mandrel 1 expands, the cylindrical recess 2 also enlarges slightly. The two halves 3 and 4 of the transducer are then emplaced opposite each other in the cylindrical recess 2, and the mandrel 1 is allowed to cool. As it cools, the recess 2 contracts with the result that the piezoelectric elements 5 and 5' are compressed and pre-stressed. If in a given case the tolerances are especially tight, in addition to heating (expanding) the mandrel, a charge can be exerted on the PZT elements to cause them to shrink slightly to facilitate assembly.

The function of the tool is to produce stress waves in oilfield tubulars such as drill pipe and production tubing. These stress waves act as carrier waves to transmit information by wireless means in wells that are being drilled or produced, for example. This allows for communication between the surface and below-surface components, such as drill bits and completion equipment. Because of the interference fit, in practice, the lengths of the cylinders and the slot in the mandrel that receives them must be held to close machining tolerances.

The remainder of this disclosure concerns a different design that preserves the advantages of the earlier '836 patent design, but allows for wider tolerances. It is also easier to assemble, and allows more precise control of the state of prestress. In this embodiment, the two cylindrical halves of the original transducer elements are replaced by a single complete hollow cylindrical element. This new single element is considerably easier to manufacture than the two half cylinders. The slot in the original mandrel is, in this embodiment, formed by two pieces: the mandrel and the separate hollow cylindrical anvil. Specifically, as described in detail below, a machined portion of the mandrel provides one boundary of the slot and the edge of the anvil provides the other boundary. The anvil is placed onto the mandrel as a thermal interference fit. Using this improved assembly, the ceramics (piezoelectric elements) can be placed in a controlled state of compression.

Figure 2:
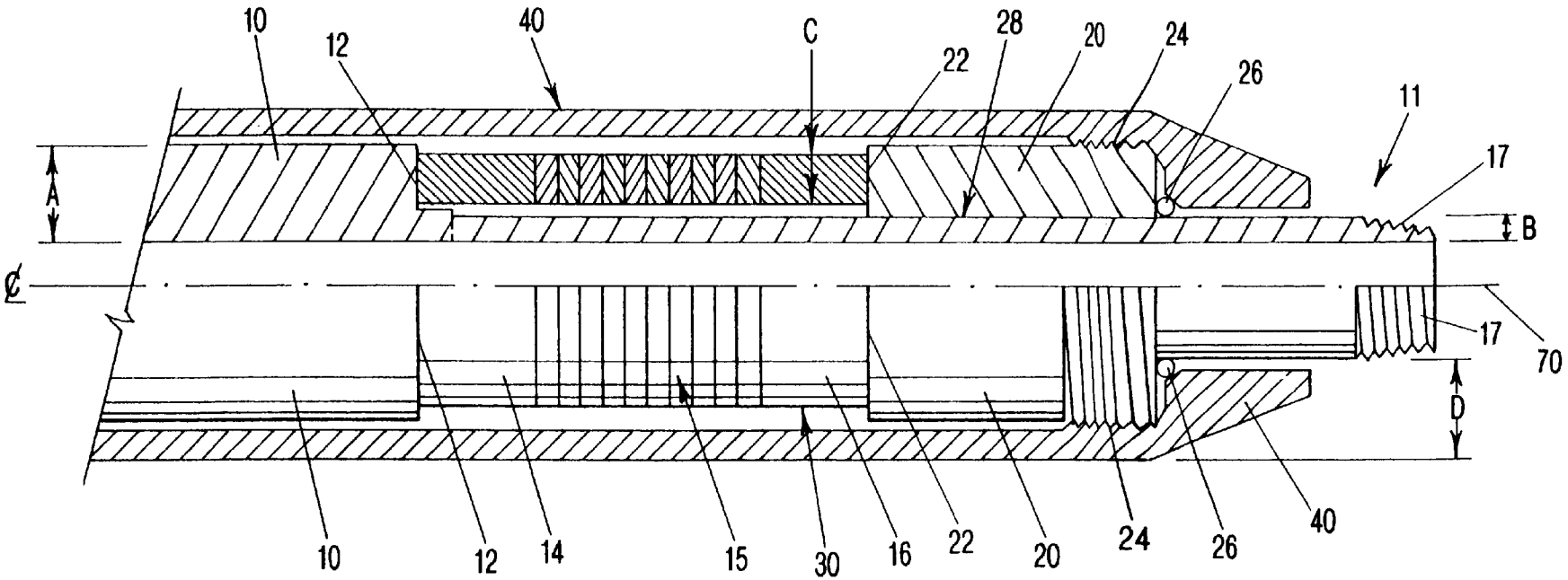
FIG. 2 is a cross section view of a portion of an acoustic transducer mandrel with transducer elements positioned according to an new embodiment different from that described in the '836 patent.

FIG. 2 illustrates a partially cut-away view of the portion of the apparatus of the present invention that includes the ceramic transducer elements. Where cylindrical elements are described, they generally share a single central axis of symmetry 70, as shown, when in their assembled configuration. It is recognized that in practice, some of the elements may not be precisely aligned along the same axis of symmetry, however, for convenience in this disclosure the single central axis of symmetry 70 is defined and used as a general point of reference. The claims are intended to encompass cases where slight deviations relative to the axis of symmetry are present. The claimed invention is robust in the respect that it can operate within a range of tolerances.

Referring to the figure, a hollow tubular mandrel 10, typically comprised of steel, is provided. (It is recognized that other suitable materials exist and will be apparent to those skilled in the art of drilling operations. Unless otherwise noted, where steel is specified herein, other suitable materials are intended to fall within the description.) The mandrel 10 has been machined or otherwise shaped to include a first region of a given thickness A between the inner and outer surfaces, and a second region of a different given thickness B between the inner and outer surfaces. Thickness A is greater than thickness B, and a surface is described delineating the boundary of the first region. This surface is generally perpendicular to the central axis of symmetry 70 and for purposes of this description will be referred to as the mandrel shoulder 12 which likewise serves as one boundary of a slot (analogous to that described above) into which a sandwich-style transducer is emplaced.

Also shown in the figure is the sandwich-style transducer 30 comprising two cylindrical thermal expansion compensators 14, 16 and a stack of washer-shaped piezoelectric elements 15 positioned between the compensators. Thus, the sandwich-style transducer 30 describes a hollow cylindrical component including both an inner and outer annular surface as well as first and second edges, one on each end of the cylinder. The sandwich-style transducer 30 is positioned over the narrower portion of the mandrel 10 so that its first edge is flush against the mandrel shoulder 12.

The figure also illustrates a hollow cylindrical anvil 20 including, at one of its ends, a threaded region 24 and, at its opposite end, a surface, which is generally perpendicular to the central axis of symmetry 70. For purposes of this description, that surface is referred to as the anvil base 22. The anvil 20 is also positioned over the narrower portion of the mandrel 10 so that the anvil base 22 is flush against the second edge of the sandwich-style transducer 30. (Details about how the anvil is positioned, and how an interference fit is accomplished, are provided later in this disclosure.) In this way, the sandwich-style acoustic transducer 30 is captured between the mandrel shoulder 12 and the anvil base 22.

A cylindrical pressure housing 40 is positioned about the previously described components. It surrounds the entire assembly just described, except that a portion of the narrower part of the mandrel (the second region of the mandrel having thickness B) extends beyond the housing 40 and bears a terminus 11 which, in the preferred embodiment, includes threads 17. Also shown in the figure is an o-ring 26 which is used in the preferred embodiment to form a seal between the housing 40, the anvil 20 and the mandrel 10 in the location shown in the figure where portions of each of those elements are in close proximity. An interference fit 28 exists between the anvil 20 and the mandrel 10 in the final tool thus assembled, and is discussed further below in conjunction with the method of assembly of the tool. Finally, shown in the figure are two additional dimensions that will be of significance when the preferred steps taken in assembling the tool are discussed, below. These are the dimension C representing the distance between the inner and outer diameter of the cylindrical sandwich-style ceramic transducer 30 and the dimension D representing the distance from the outer surface of the narrower portion of the mandrel 10 and the outer perimeter surface of the housing 40. In order to optimize the advantages of the invention, it is important to select parts that minimize the dimension D and simultaneously maximize the dimension C, while still accommodating assembly, operational stresses, and well bore size constraints. Maximizing the dimension C is strongly encouraged since the capability and functionality of the sandwich transducer increases with the size of the ceramic elements stacked together to form the transducer.

Figure 3:
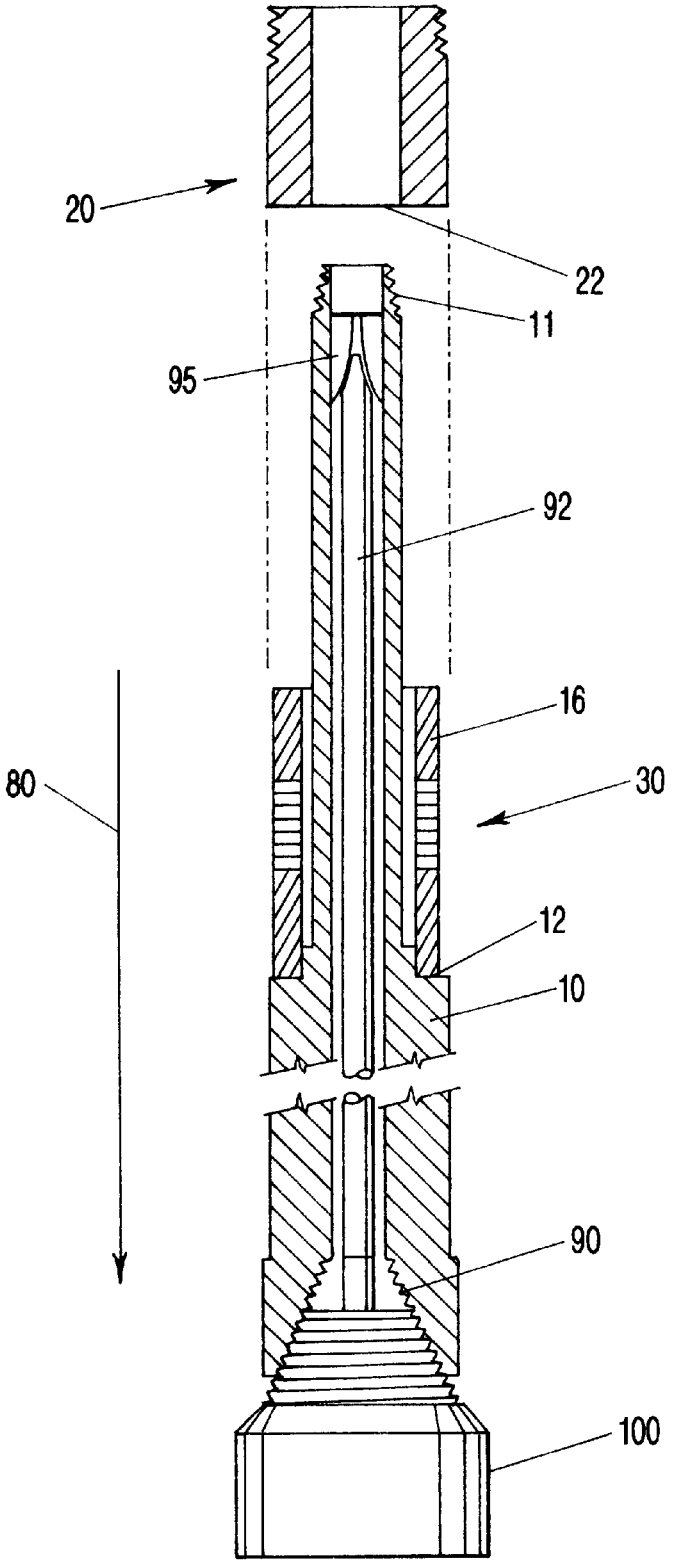
FIG. 3 is a partial cross-sectional view of one embodiment of an acoustic transducer tool and assembly equipment illustrating an extension method of the assembling tool components.

Assembly of the tool just described is accomplished with the aid of a commercial hydraulic jack. This is illustrated in FIG. 3. In the preferred embodiment, the hydraulic jack 100 is connected to the wider end of the mandrel 10 which, as illustrated in the figure, has been modified to include oilfield threads 90 that can be screwed onto the hydraulic jack, as shown. (The use of female oilfield threads in this fashion helps to accomplish the objective, mentioned above, to minimize dimension D.) It is recognized and expected, however, that other methods of securing the mandrel 10 to the jack 100 will be known and used by skilled practitioners in the art, and such other methods are within intended to be within the scope of the appended claims.

Next, in the preferred embodiment a push rod 92 is placed in the central opening of the hollow cylindrical mandrel 10, and a removable friction-slip assembly 95 is placed on top of the push rod. The friction-slip assembly serves as a barrier against which force can be exerted by the push rod 92. Alternative means for creating such a barrier exist and will be apparent to those skilled in the art practicing the invention. For example, if dimension B allows, threads can be included at the terminus 11 of the mandrel 10, and a cap can be screwed on to create a surface against which the push rod 92 will push, in the operation described below. Likewise, the mandrel can include a welded (or otherwise integral) plug in the region of the terminus 11 of the mandrel. It is also possible for the mandrel to be manufactured from a single drilled-out billet with an undrilled portion in the region of the terminus 11. In both of these latter examples, after stretching is accomplished (as described below), the portion of the terminus 11 including the barrier or plug can be cut off an discarded.

Using this arrangement, the jack 100 is used to temporarily extend the length (stretch) the mandrel 10 by pulling the mandrel in the relative direction shown by the arrow 80 against the resistance provided by the push rod 92. Typically, in the case of a steel mandrel of the type commonly used in oil field applications, approximately 40,000 to 80,000 pounds of load on the jack will stretch the mandrel an appropriate amount without plastically deforming it. Next, the sandwich-style transducer 30 is slid over the narrower part of the mandrel 10 into position against the mandrel shoulder 12. In order to aid in this process, an alignment shoulder can be machined into the mandrel.

Next, the anvil 20 is heated to a temperature sufficient to allow it, due to thermal expansion, to slide into position so that the anvil base 22 lies adjacent to the sandwich-style transducer 30. It may be necessary for care to be taken, using techniques known to those skilled in the art, to cool or otherwise protect the expansion compensator 16, which will contact the anvil base 22. As the anvil 20 cools to ambient temperature it will shrink to an interference fit with the mandrel 10. After sufficient cooling, the hydraulic jack 100, push rod 92 and friction-slip assembly 95 are released and removed. The mandrel 10 returns substantially to its original dimensions, and, in doing so the ceramics in the sandwich-style transducer 30 are subjected to compression. The final level of compression is controlled by the initial stretch imposed by the hydraulic jack as well as the secondary heating of the expansion compensator by contact with the heated anvil.

It is also possible to screw the anvil into place on the mandrel, but this is not the preferred approach since several undesirable effects can occur: First, doing so requires a set of threads on the mandrel that will increase the dimension D and reduce the dimension C, thereby reducing the size and capability of the sandwich transducer. As it is tightened, the anvil will make contact with the sandwich transducer in a rotating fashion. It is commonly known that this can produce undesirable strains in the sandwich elements. The threads will also greatly increase the elastic compliance of the final mandrel-anvil assembly, perhaps by as much as a factor of ten. This decreases the transfer of motion from the sandwich transducer to the mandrel, thereby weakening the stress waves that can be produced.

After the anvil is positioned and the sandwich elements are stressed appropriately, the remaining parts necessary for operation of the tool, including the o-ring seal and external housing pictured in FIG. 2, are assembled prior to deployment of the tool.

The particular sizes and equipment discussed above are cited merely to illustrate particular embodiments of the invention. It is contemplated that the use of the invention may involve components having different sizes and characteristics. It is intended that the scope of the invention be defined by the claims appended hereto.

From the foregoing description, one skilled in the art can easily ascertain the essential characteristics of the invention defined in this specification and the appended claims, and without departing from the spirit and scope thereof can make various changes and modifications of the invention to adapt it to various usages and conditions. Such changes and modifications as would be obvious to one skilled in the art are intended to be included within the scope of the following claims. The entire disclosures of all references, applications, patents and publications cited above are hereby incorporated by reference.

I claim:

1. An active acoustic transducer comprising:

a) a one-piece mandrel in the form of a modified cylinder substantially symmetric about a central axis and having:

a first mandrel region including an outer surface substantially parallel to the central axis and at a first substantially constant radial distance from the central axis, and a second mandrel region including an outer surface substantially parallel to the central axis and at a second substantially constant radial distance from the central axis, the second substantially constant radial distance being less than the first substantially constant radial distance, whereby the first region includes a shoulder member extending from the outer surface of the first region to the outer surface of the second region, b) an anvil in the form of a cylinder substantially symmetric about the central axis and having:

first and second ends, an outer anvil surface substantially parallel to the central axis and at a third substantially constant radial distance from the central axis, and a central aperture bound by an inner anvil surface that is substantially parallel to the central axis, the inner anvil surface being at a fourth substantially constant radial. distance from the central axis, the fourth substantially constant radial distance being less than the third substantially constant radial distance, whereby the anvil includes a base member in the region of the first end extending from the outer anvil surface to the inner anvil surface, the anvil being positioned so that part of the second region of the mandrel passes through the central aperture bound by the inner surface of the anvil, and c) a plurality of washer-shaped discs comprising piezoelectric material and having an outer radius and an inner radius, the inner radius being slightly larger than the substantially constant radial distance associated with the outer surface of the second region of the mandrel, and the outer radius being larger than the inner radius, the plurality of discs being captured between the shoulder member of the first region of the mandrel and the base of the anvil in a pre-stressed interference fit.

2. The active acoustic transducer of claim 1 wherein the one-piece mandrel is hollow.

3. The active acoustic transducer of claim 1 wherein the one-piece mandrel comprises steel.

4. The active acoustic transducer of claim 2 wherein the one-piece mandrel comprises steel.

5. The active acoustic transducer of claim 1 wherein the anvil is secured to the mandrel by way of an interference fit between the inner anvil surface and the outer surface of the second mandrel region.

6. The active acoustic transducer of claim 2 wherein the anvil is secured to the mandrel by way of an interference fit between the inner anvil surface and the outer surface of the second mandrel region.

7. The active acoustic transducer of claim 3 wherein the anvil is secured to the mandrel by way of an interference fit between the inner anvil surface and the outer surface of the second mandrel region.

8. The active acoustic transducer of claim 4 wherein the anvil is secured to the mandrel by way of an interference fit between the inner anvil surface and the outer surface of the second mandrel region.

9. The active acoustic transducer of claim 6 further comprising a cylindrical pressure housing enclosing the anvil, the plurality of discs and part of the mandrel.

10. The active acoustic transducer of claim 7 further comprising a cylindrical pressure housing enclosing the anvil, the plurality of discs and part of the mandrel.

11. The active acoustic transducer of claim 8 further comprising a cylindrical pressure housing enclosing the anvil, the plurality of discs and part of the mandrel.

12. The active acoustic transducer of claim 9 further comprising at least one O-ring sealing at least one juncture where portions of the mandrel, the anvil and the cylindrical pressure housing are all positioned in proximity to each other.

13. The active acoustic transducer of claim 10 further comprising at least one O-ring sealing at least one juncture where portions of the mandrel, the anvil and the cylindrical pressure housing are all positioned in proximity to each other.

14. The active acoustic transducer of claim 11 further comprising at least one O-ring sealing at least one juncture where portions of the mandrel, the anvil and the cylindrical pressure housing are all positioned in proximity to each other.

15. The active acoustic transducer of claim 12 wherein the ends of the mandrel are adapted to connect to threaded tubing.

16. The active acoustic transducer of claim 13 wherein the ends of the mandrel are adapted to connect to threaded tubing.

17. The active acoustic transducer of claim 14 wherein the ends of the mandrel are adapted to connect to threaded tubing.

* * * * *